US007225996B2

(12) United States Patent
Kobayashi et al.

(10) Patent No.: US 7,225,996 B2
(45) Date of Patent: Jun. 5, 2007

(54) FUEL SUPPLY METHOD AND FUEL SUPPLY SYSTEM FOR FUEL INJECTION DEVICE

(75) Inventors: Masayoshi Kobayashi, Kobe (JP); Hiroyuki Ninomiya, Akashi (JP); Hiroaki Miyamoto, Akashi (JP); Takeo Oda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 69 days.

(21) Appl. No.: 10/809,693

(22) Filed: Mar. 26, 2004

(65) Prior Publication Data

US 2005/0139695 A1 Jun. 30, 2005

(30) Foreign Application Priority Data

Dec. 25, 2003 (JP) ..... 2003-430408
Jan. 21, 2004 (JP) ..... 2004-12585

(51) Int. Cl.
*F02M 47/02* (2006.01)
*F02M 59/00* (2006.01)
*F02M 39/00* (2006.01)
*B05B 1/30* (2006.01)

(52) U.S. Cl. ..... 239/88; 239/89; 239/533.1; 239/533.2; 239/533.3; 239/91

(58) Field of Classification Search ..... 239/88–95, 239/533.1, 533.2, 533.3; 123/470, 456, 468, 123/469

See application file for complete search history.

(56) References Cited

U.S. PATENT DOCUMENTS

| | | | | |
|---|---|---|---|---|
| 3,912,164 | A | 10/1975 | Lefebvre et al. | |
| 5,178,115 | A * | 1/1993 | Daly | 123/470 |
| 5,197,288 | A | 3/1993 | Newland et al. | |
| 5,577,386 | A | 11/1996 | Alary et al. | |
| 6,256,995 | B1 | 7/2001 | Sampath et al. | |
| 6,338,445 | B1 * | 1/2002 | Lambert et al. | 239/533.12 |
| 6,431,469 | B2 * | 8/2002 | Lambert et al. | 239/533.3 |
| 6,471,142 | B1 * | 10/2002 | Lambert | 239/88 |
| 6,484,489 | B1 | 11/2002 | Foust et al. | |
| 6,637,675 | B2 * | 10/2003 | Carroll et al. | 239/533.4 |
| 2003/0141388 | A1 | 7/2003 | Johnson et al. | |

FOREIGN PATENT DOCUMENTS

| | | |
|---|---|---|
| GB | 686 383 | 1/1953 |
| JP | A-2002-168449 | 6/2002 |
| JP | A 2003-4231 | 1/2003 |

* cited by examiner

*Primary Examiner*—Davis Hwu
(74) *Attorney, Agent, or Firm*—Oliff & Berridge, PLC

(57) ABSTRACT

A fuel injection device includes a fuel injection unit provided with a plurality of fuel injection members. The fuel injection unit is held by a holding-and-supplying unit. The fuel injection members are connected to the holding-and-supplying unit by a connecting-and-supplying unit. A fuel is supplied to the fuel injection members through fuel supply passages formed in the holding-and-supplying unit and the connecting-and-supplying unit so as to extend from the holding-and-supplying unit through the connecting-and-supplying unit to the fuel injection members.

7 Claims, 5 Drawing Sheets

FUEL SUPPLY METHOD AND FUEL SUPPLY SYSTEM FOR FUEL INJECTION DEVICE

BACKGROUND OF THE INVENTION

1. Technical Field

The present invention relates to a fuel supply method for fuel injection members of a fuel injection device, and a fuel supply system for carrying out the fuel supply method, more specifically, to a fuel supply method for fuel injection members of a fuel injection device of a gas turbine so as to achieve low-$NO_x$ operation, and a fuel supply system for carrying out the fuel supply method.

2. Description of the Related Art

There has been a demand in recent years for a fuel injection nozzle for combustors, capable of injecting fuel such that the exhaust gas has a low $NO_x$ concentration, owing to the recent progressively growing severity of controls concerning $NO_x$ emission imposed on aero and industrial combustors. To achieve low-$NO_x$ combustion, the fuel injection nozzle is required to inject fuel such that the mean flame temperature is low and temperature distribution in flames is uniform. Fuel must be mixed with a large amount of air to lower the mean flame temperature and to make temperature distribution in flames uniform.

Although no problem arises in combustion in a combustor while the combustor is operating in high-power setting, combustion becomes unstable while the combustor is operating in low-power or middle-power setting, when fuel is jetted by a conventional fuel injection nozzle N having a single fuel passage 101 as shown in FIG. 4 and the fuel is mixed in a large amount of air for low-$NO_x$ combustion.

As shown in FIG. 5, an improved fuel injection system A' obtained by altering the conventional fuel injection nozzle N has been proposed as a means for avoiding unstable combustion that occurs in the low-power or middle-power setting. The fuel injection system A' has a plurality of series of swirl vanes 201 which are concentrically arranged in different radial positions, and a plurality of series of fuel injection mechanisms 202 which are concentrically arranged in different radial positions. The operation of the fuel injection mechanisms 202 is regulated according to engine power settings, and the amount of air into which the fuel is mixed is regulated. The fuel injection system A' is capable of injecting fuel for the so-called staging combustion.

In the previously proposed fuel injection system A', fuel is supplied to the fuel injection mechanisms 202 through fuel supply pipes 203 extended through the casing of a gas turbine. Consequently, the flow of combustion air is disturbed and turbulences of the flow of combustion air are caused, thereby, combustion air cannot properly supplied to the fuel injection mechanisms 202. There is the possibility that welded joints of the fuel injection mechanisms 202 and the fuel supply pipes 203 are damaged or cracks develop therein due to difference in thermal expansion between the fuel injection mechanisms 202 and the fuel supply pipes 203. Moreover, the fuel supply pipes 203 are obstacles to assembling work for assembling the gas turbine.

SUMMARY OF THE INVENTION

Accordingly, it is an object of the present invention to provide a fuel supply method and a fuel supply system for a fuel injection device that has a plurality of concentrically arranged swirl vanes and a plurality of concentrically arranged fuel injection mechanism, and the fuel supply method and system provide facilitating work for assembling a fuel injection system into a gas turbine, properly supplying combustion air into the fuel injection device, and no thermal expansion problems.

According to a first aspect of the present invention, a fuel supply method for a fuel injection device including a fuel injection unit provided with a plurality of fuel injection members, comprises: holding the fuel injection unit by a holding unit, and connecting the fuel injection members to the holding unit by a connecting unit; wherein a fuel is supplied to the fuel injection members through fuel supply passages formed in the holding unit and the connecting-and-supplying unit so as to extend from the holding unit through the connecting unit to the fuel injection members.

Preferably, portions of the fuel passages formed in the holding unit and portions of the fuel passages formed in the connecting unit are connected in a liquid-tight fashion.

According to a second aspect of the present invention, a fuel supply system for a fuel injection device including a fuel injection unit provided with a plurality of fuel injection members, comprises: a holding-and-supplying unit configured to hold the fuel injection unit and supply fuel to each of the fuel injection members of the fuel injection unit; and a connecting-and-supplying unit configured to connect the plurality of fuel injection members to the holding-and-supplying unit, wherein fuel supply passages are formed in the holding-and-supplying unit and the connecting-and-supplying unit so as to extend from the holding-and-supplying unit through the connecting-and-supplying unit to the fuel injection members.

Preferably, portions of the fuel supply passages formed in the connecting-and-supplying unit are formed so as to overlap each other with respect to a flowing direction of combustion air.

Preferably, portions of the fuel passages formed in the holding-and-supplying unit and portions of the fuel passages formed in the connecting-and-supplying unit are connected by connecting pieces fitted in the holding-and-supplying unit and the connecting-and-supplying unit in a liquid-tight fashion.

According to a third aspect of the present invention, a fuel injection device comprises one of the above-mentioned fuel supply systems.

The present invention facilitates work for assembling a gas turbine and is capable of properly supplying combustion air to the fuel injection device. Since there is no individual fuel supply pipe, it is free from troubles attributable to fuel supply pipes.

DESCRIPTION OF THE PREFERRED EMBODIMENTS

Preferred embodiments of the present invention will be described with reference to the accompanying drawings by way of example.

Figure 1:
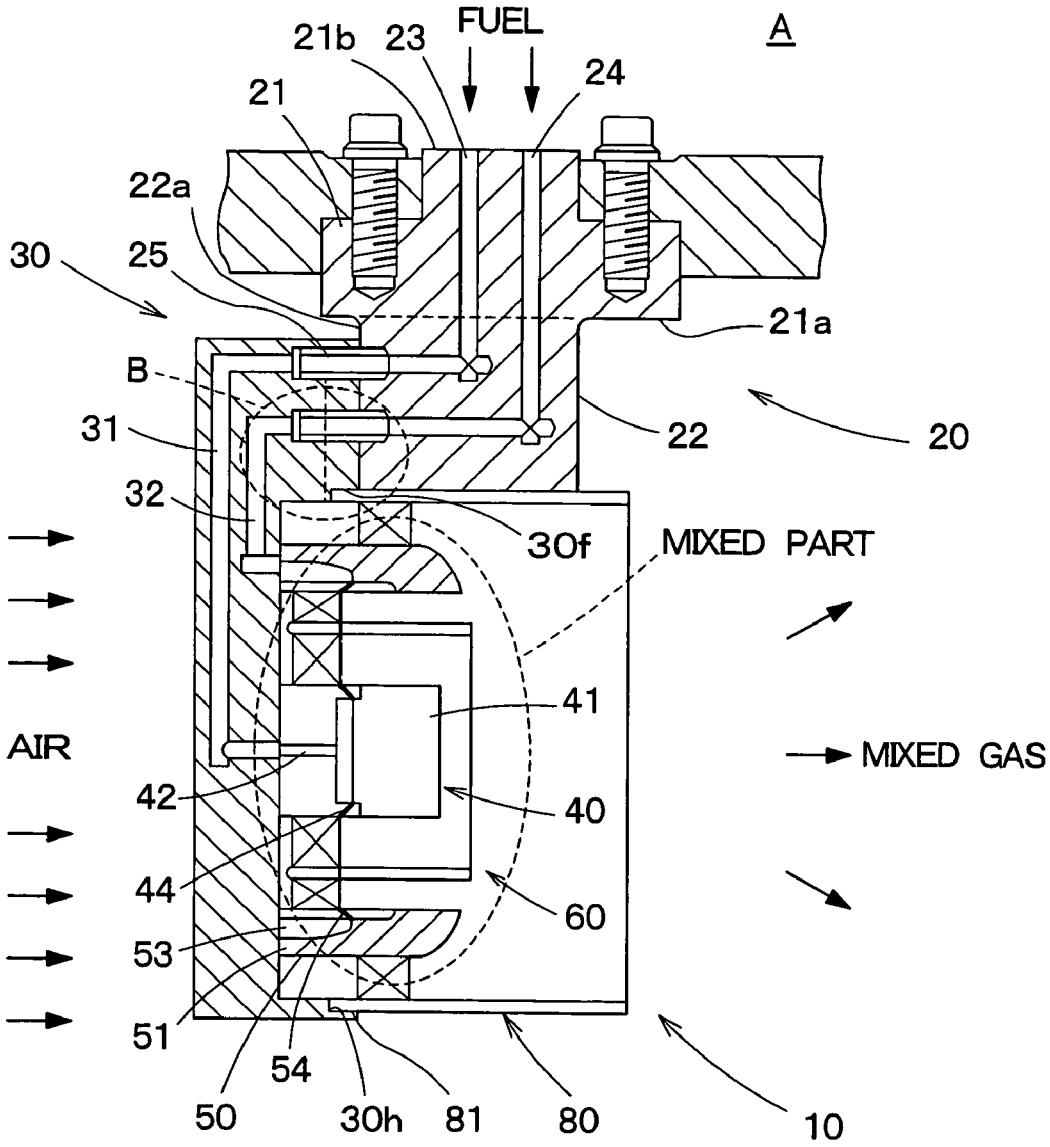
FIG. 1 is a sectional view of a fuel injection device including a fuel supply system in a preferred embodiment according to the present invention, to which a fuel supply method in a preferred embodiment according to the present invention is applied.
Figure 2:
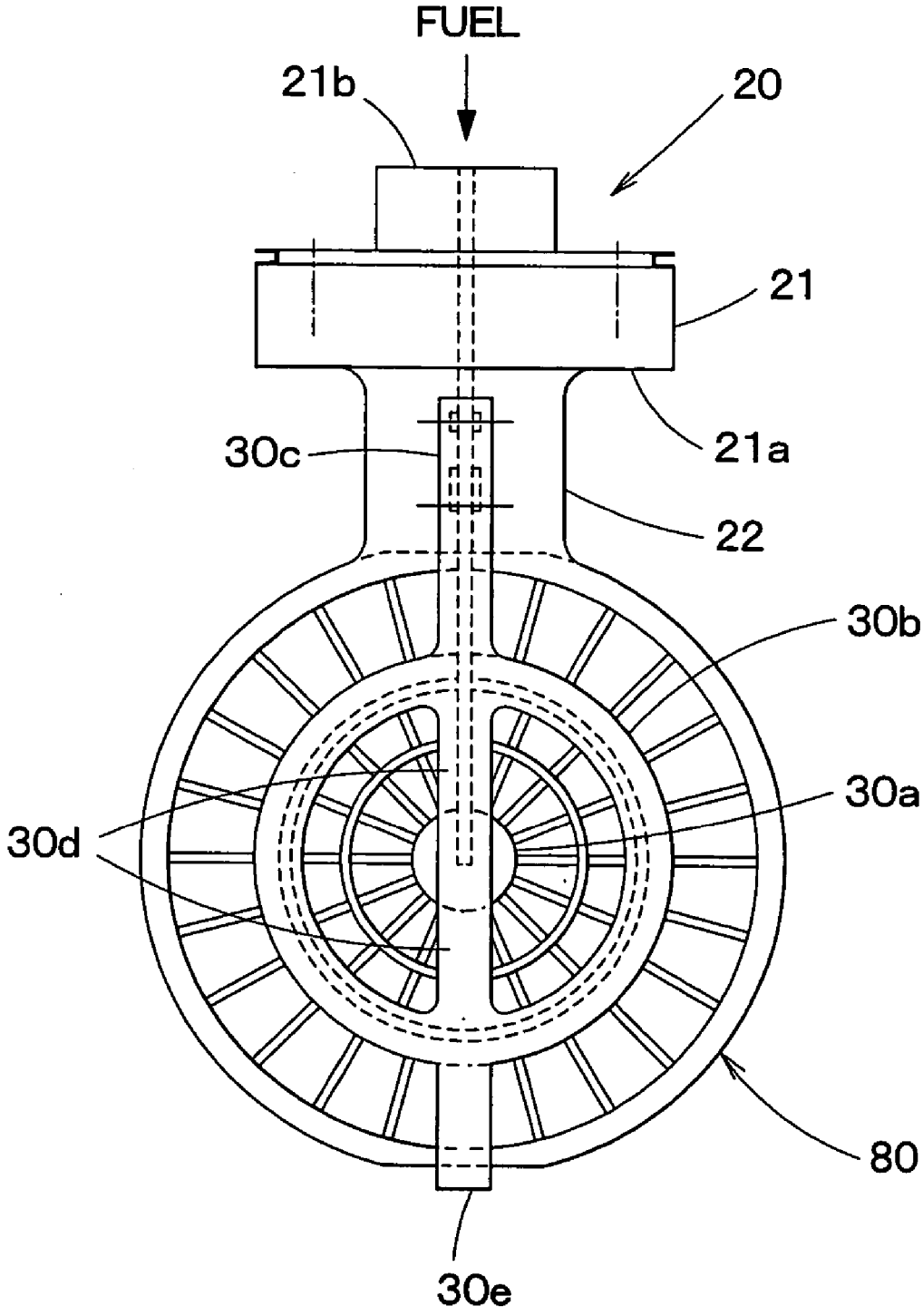
FIG. 2 is a front elevation of the fuel injection device shown in FIG. 1.

Referring to FIGS. 1 and 2 showing a fuel injection device A for a gas turbine combustor, including a fuel supply system to which a fuel supply method in the present embodiment is applied, the fuel injection device A includes, as principal components, a fuel injection unit 10 that injects fuel and produces fuel-air mixture into a combustor, a holding-and-supplying unit 20 holding the fuel injection unit 10, and a connecting-and-supplying unit 30 connecting the fuel injection unit 10 and the holding-and-supplying unit 20. The holding-and-supplying unit 20 and the connecting-and-supplying unit 30 are configured to form passages for supplying fuel to the fuel injection unit 10.

As shown in FIGS. 1 and 2, the fuel injection unit 10 includes a first fuel injection member 40 disposed in a central part of the fuel injection unit 10, a second fuel injection member 50 surrounding the first fuel injection member 40, an atomizing mechanism 60 disposed between the first fuel injection member 40 and the second fuel injection member 50, and around the second fuel injection member 50 to atomize injected fuel, and a mixing duct 80 surrounding the atomizing mechanism 60.

As shown in FIG. 1, the first fuel injection member 40 has a cylindrical front part 41. A fuel supply passage 42 has one end connected to the connecting-and-supplying unit 30 and the other end connected to a central part of the base end of cylindrical front end part 41. A plurality of fuel injection holes 44 are connected to the fuel supply passage 42. The first fuel injection member 40 is formed integrally with the connecting-and-supplying unit 30 by welding or brassing.

The second fuel injection member 50 has a base end part 51 provided with a longitudinally extending, annular fuel reservoir 53 of a predetermined depth. A predetermined number of fuel injection holes 54 are formed from the fuel reservoir 53 so that fuel is supplied to the fuel injection holes 54. The second fuel injection member 50 is formed integrally with the connecting-and-supplying unit 30.

As shown in FIGS. 1 and 2, the holding-and-supplying unit 20 has a flange 21 attached to a casing mount, and a neck 22 extending from the lower surface 21*a* of the flange 21 and connected to the mixing duct 80 of the fuel injection unit 10. The holding-and-supplying unit 20 is internally provided with fuel supply passages 23 and 24 extending from the upper end surface 21*b* of the flange 21 through the neck 22 to the front surface 22*a* of the neck 22. The fuel supply passage 23 communicates with a fuel passage 42 formed in the first fuel injection member 40 by means of a fuel supply passage 31 formed in the connecting-and-supplying unit 30. Similarly, the fuel supply passage 24 communicates with the fuel reservoir 53 of the second fuel injection member 50 by means of a fuel supply passage 32 formed in the connecting-and-supplying unit 30.

Figure 3:
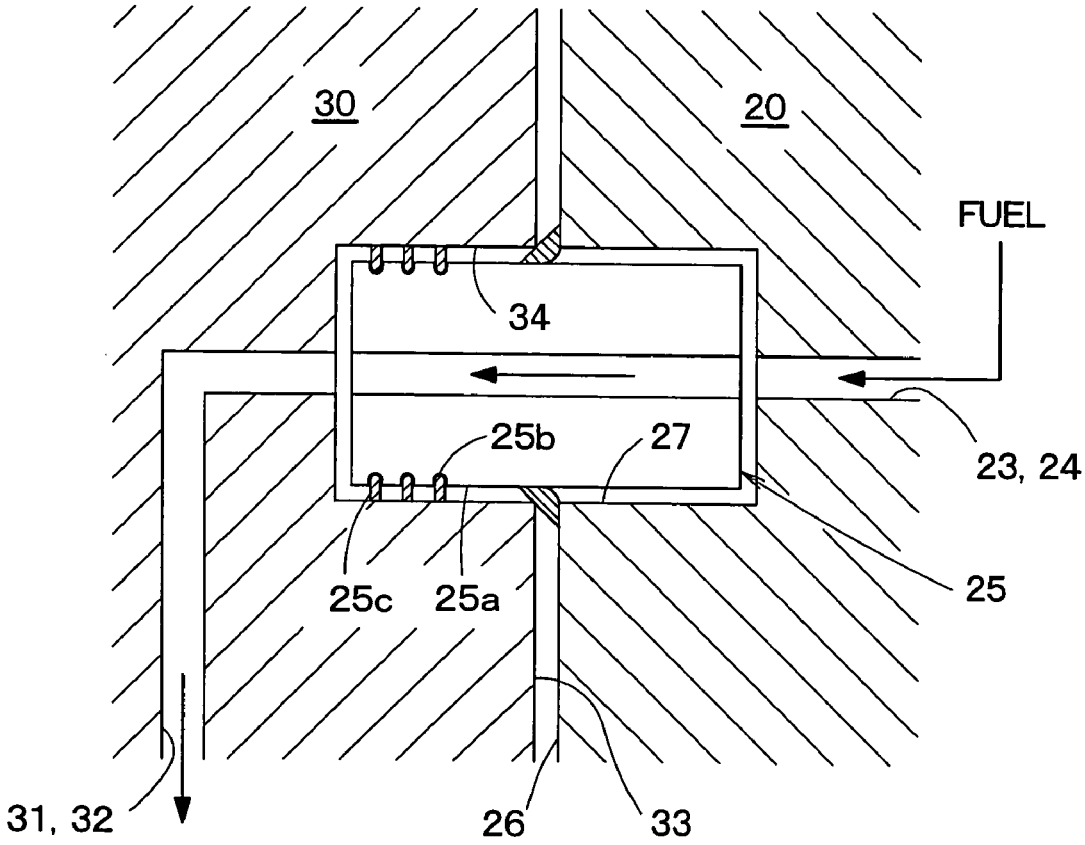
FIG. 3 is a sectional view of the part B in FIG. 1.
Figure 4:
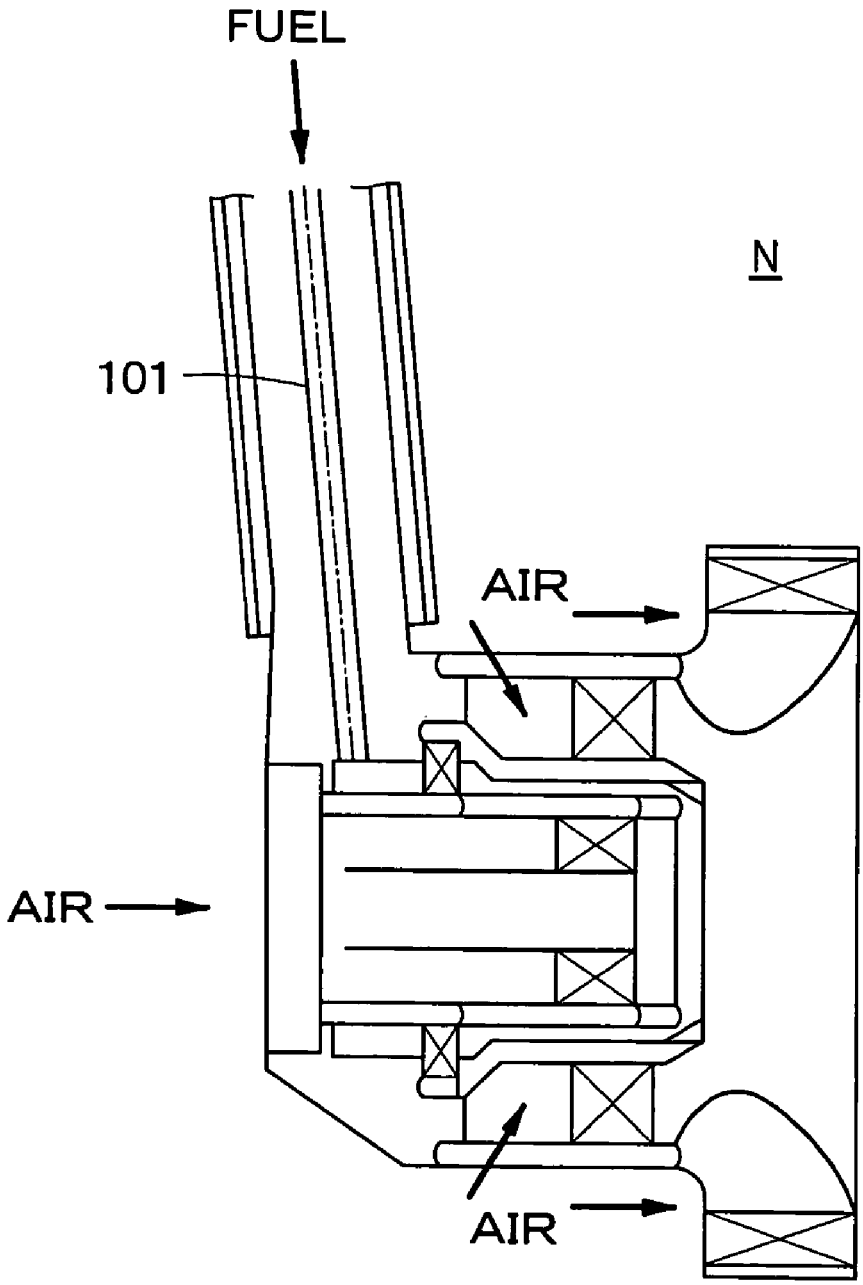
FIG. 4 is a sectional view of a conventional fuel injection nozzle.
Figure 5:
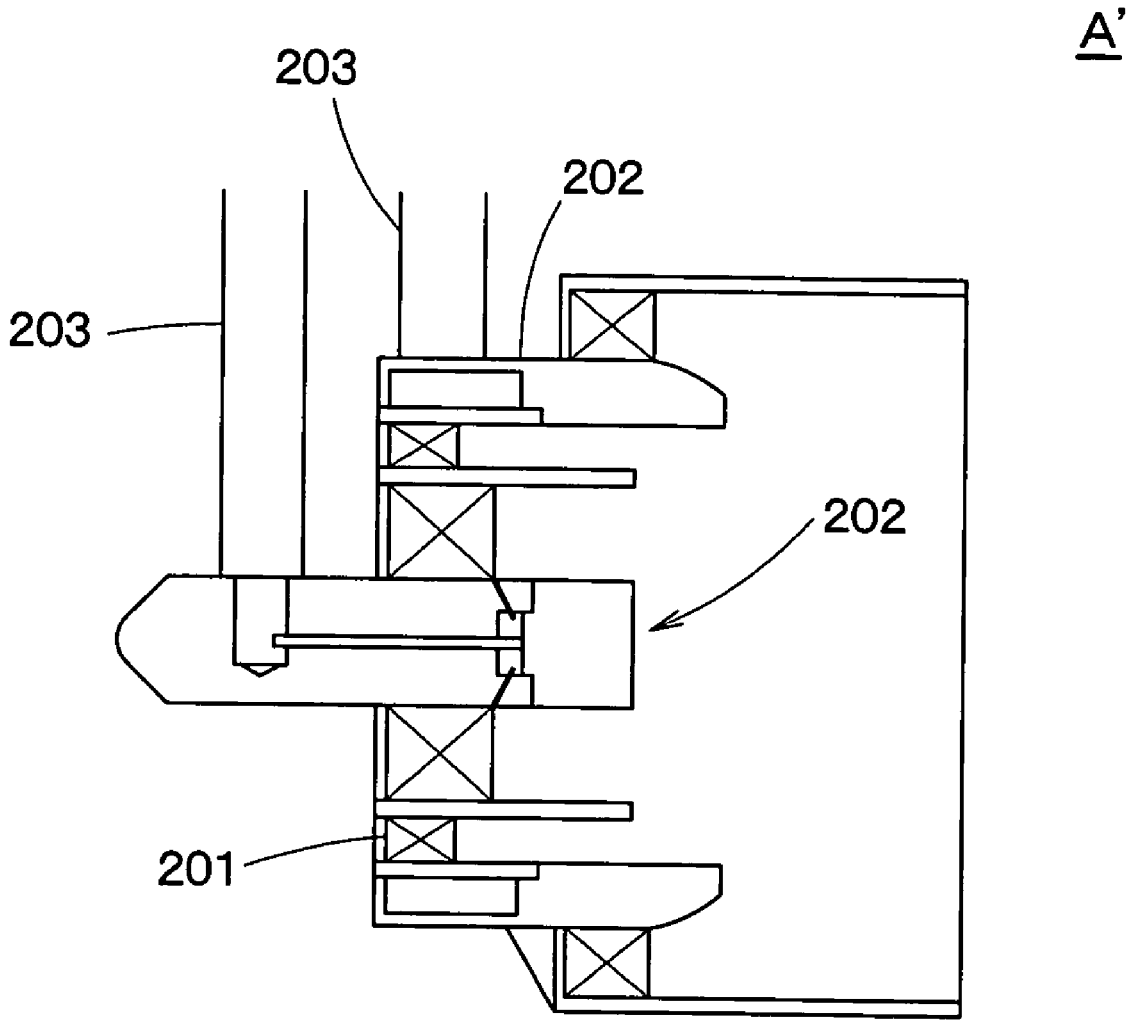
FIG. 5 is a sectional view of a conventional fuel injection device with a plurality of concentrically arranged swirl vanes and fuel injection mechanism.

The fuel supply passages 23 and 24 of the holding-and-supplying unit 20 and the fuel supply passages 31 and 32 of the connecting-and-supplying unit 30 are connected as shown in FIG. 3. Recesses 27 are formed in parts corresponding to the fuel supply passages 23 and 24 in a joining surface 26 of the holding-and-supplying unit 20, in which the fuel supply passages 23 and 24 of the holding-and-supplying unit 20 open, to be joined to the connecting-and-supplying unit 30. Connecting pieces 25 having the shape of a hollow cylinder are fitted in a liquid-tight (water-tight) fashion in the recesses 27 so that projecting parts 25*a* of a predetermined length thereof project from the recess 27. The projecting parts 25*a* of the connecting pieces 25 are fitted in recesses 34 formed in the joining surface 33 of the connecting-and-supplying unit 30 to be joined to the joining surface 26 of the holding-and-supplying unit 20. Thus, the fuel supply passages 23 and 24 of the holding-and-supplying unit 20 are connected to the fuel supply passages 31 and 32 of the connecting-and-supplying unit 30, respectively.

A plurality of annular grooves 25*b* are formed in each of the projecting parts 25*a*. Bonding materials 25*c*, such as hard solders, are filled in the annular grooves 25*b*. The projecting parts 25*a* are fitted in the recesses 34. The holding-and-supplying unit 20 and the connecting-and-supplying unit 30 are heated in a furnace to melt the bonding materials 25*c*, and then, the molten bonding materials 25*c*, the holding-and-supplying unit 20 and the connecting-and-supplying unit 30 are cooled. Thus, the bonding materials 25*c* bond the projecting parts 25*a* to the side surfaces of the recesses 34 in a liquid-tight fashion.

The connecting-and-supplying unit 30 includes a cylindrical member 30*a* disposed in a central part of the connecting-and-supplying unit 30 and having a front end joined to the first fuel injection member 40, an annular member 30*b* concentrically surrounding the cylindrical member 30*a* and having a front end joined to the second fuel injection member 50, a plate-shaped connecting member 30*c* connecting the annular member 30*b* to the holding-and-supplying unit 20, connecting members 30*d* connecting the cylindrical member 30*a* and the annular member 30*b*, and a mixing duct holding member 30*e* holding the mixing duct 80 on the annular member 30*b*. All these members are formed by machining in a single unitary piece without using welding. Combustion air passages through which combustion air flows into the atomizing mechanism 60 are formed between the cylindrical member 30*a* and the annular member 30*b*, and around the annular member 30*b*.

The fuel supply passage 31 extends through the annular member 30*b* and the connecting members 30*d* to the fuel supply passage 42 of the first fuel injection member 40. The fuel supply passage 32 extends through the annular member 30*b* to the fuel reservoir 53 of the second fuel injection member 50. The fuel supply passages 31 and 32 are arranged so as to overlap each other with respect to the flowing direction of combustion air. For example, the fuel supply passages 31 and 32 are extended vertically and arranged longitudinally, to avoid uselessly increasing the width, i.e., a dimension with respect to a direction perpendicular to the flowing direction of combustion air, of the connecting member 30*c*, and to avoid uselessly increasing resistance against the flow of combustion air.

The connecting member 30*c* has the shape of the inverted letter L. The connecting member 30*c* has a horizontal part having an end joined to the holding-and-supplying unit 20 and provided with a stepped part 30*f* in which a base end part 81 of the mixing duct 80 is fixedly fitted. The fuel supply passages 31 and 32 connected to the fuel supply passages 23 and 24 of the holding-and-supplying unit 20 are formed in the connecting member 30*c*. The projecting parts 25*a* are fitted in recesses 34 formed in parts corresponding to the fuel supply passages 31 and 32 and formed in the end surface of the connecting-and-supplying unit 30 facing the holding-and-supplying unit 20.

The mixing duct holding member 30*e* is formed in the shape of a deformed letter L and has a thin horizontal part. A stepped part 30*h* is formed in a front end part of the horizontal part. The base end part 81 of the mixing duct 80 is fixedly fitted in the stepped part 30*h*.

Although the connecting-and-supplying unit 30 is cooled by fuel and the connecting-and-supplying unit 30 tends to shrink relative to the mixing duct 80, there is not any difference in thermal expansion between the connecting-and-supplying unit 30 and the mixing duct 80 because the base part 81 of the mixing duct 80 is fixedly fitted in the stepped parts 30*f* and 30*h* of the connecting-and-supplying unit 30. Since only the thermal expansion difference between parts of the holding-and-supplying unit 20 and the connecting-and-supplying unit 30 within a short distance from the joint of the holding-and-supplying unit 20 and the connecting-and-supplying unit 30 needs to be taken into consideration in estimating a shearing stress that may be induced in the joint in designing the holding-and-supplying unit 20 and the connecting-and-supplying unit 30, shearing force that may act on the connecting pieces 25 can be reduced, the possibility of fuel leakage due to the breakage of the connecting pieces 25 can be reduced, and the fuel supply passages can be surely connected in a liquid-tight fashion.

The words upper and lower are used for designating upper and lower parts as viewed in FIGS. 1 and 2 for convenience and do not necessarily designate upper and lower parts on the combustor of an actual gas turbine.

In the fuel supply system of the present embodiment thus constructed, the fuel supply passages 23 and 24 are formed in the holding-and-supplying unit 20, and the fuel supply passages 31 and 32 are formed in the connecting-and-supplying unit 30; that is, the holding-and-supplying unit 20 and the connecting-and-supplying unit 30 are internally provided with the fuel supply passages 23, 24, 31 and 32 connected to the first fuel injection member 50 and the second fuel injection member 50. Therefore, the fuel supply system does not need any fuel supply pipes and is simple in construction. The elimination of fuel supply pipes prevents the occurrence of troubles due to fuel supply pipes. For example, preventive means for preventing the breakage of fuel supply pipes liable to occur in installing a fuel supply system are unnecessary, and hence the fuel supply system can be efficiently assembled. The fuel supply system is free from troubles due to the difference in thermal expansion between fuel supply pipes and a supporting part.

Various modifications of the foregoing fuel supply system are possible. For example, the fuel supply system may be provided with a third fuel injection member surrounding the second fuel injection member 50 in addition to the first fuel injection member 40 and the second fuel injection member 50. When the fuel injection device A is disposed at a lower portion of the annular combustor instead of an upper portion of the combustor, "upper" and "lower" used in the foregoing description are replaced with "lower" and "upper", respectively.

Although the invention has been described in its preferred embodiment, obviously many changes and variations are possible therein. It is therefore to be understood that the present invention may be practiced otherwise than as specifically described herein without departing from the scope and spirit thereof.

What is claimed is:

1. A fuel injection device including a fuel injection unit and a fuel supply system supplying fuel to the fuel injection unit, the fuel injection unit comprising:

a plurality of fuel injection members including a first fuel injection member disposed in a center of the fuel injection unit and an annular second fuel injection member surrounding the first fuel injection member, each of the fuel injection members having a port through which fuel is injected;

an atomizing mechanism configured to atomize fuel which is injected from the fuel injection members; and a mixing duct surrounding the fuel injection members and the atomizing mechanism, wherein annular air passages for combustion air are formed between the first fuel injection member and the annular second fuel injection member, and between the annular second injection member and the mixing duct, so that fuel is atomized and mixed with the combustion air flowing through the annular air passages by means of the atomizing mechanism, the fuel supply system comprising:

a holding-and-supplying unit configured to hold the fuel injection unit and supply fuel to each of the fuel injection members of the fuel injection unit; and a connecting-and-supplying unit configured to connect the plurality of fuel injection members to the holding-and-supplying unit, wherein fuel supply passages are formed in the holding-and-supplying unit and the connecting-and-supplying unit so as to extend from the holding-and-supplying unit through the connecting-and-supplying unit to the fuel injection members, wherein the fuel supply passages of the holding-and-supplying unit and the connecting-and-supplying unit are connected to teach other via a connecting piece having a hollow cylinder shape, the connecting piece being fitted in a liquid-tight fashion into recesses respectively formed in joining surfaces of the holding-and-supplying unit and the connecting-and-supplying unit, wherein the connecting-and-supplying unit includes a cylindrical member disposed in a center of the connecting-and-supplying unit and having a front end joined to the first fuel injection member, an annular member concentrically surrounding the cylindrical member and having a front end joined to the second fuel injection member, a plate-shaped first connecting member connecting the annular member to the holding-and-supplying unit, a second connecting member connecting the cylindrical member and the annular member to each other, and a mixing duct holding member holding the mixing duct on the annular member, all of the cylindrical member, the annular member, the plate-shaped first connecting member, the second connecting member, and the mixing duct holding member being integrally formed.

2. The fuel injection device according to claim 1, wherein the plurality of fuel injection members further comprise an annular third fuel injection member surrounding the annular second fuel injection member.

3. A fuel injection device according to claim 1, wherein portions of the fuel supply passages formed in the connecting-and-supplying unit are formed so as to overlap each other with respect to a flowing direction of combustion air.

4. A fuel injection device according to claim 1, wherein the connecting piece is fixed to the recesses of the holding-and-supplying unit and the connecting-and-supplying unit with bonding materials.

5. A fuel injection device according to claim 1, wherein the mixing duct holding member is formed in a shape of a deformed letter L so as to have a thin horizontal part, a stepped part being formed in a front end part of the horizontal part, a base end part of the mixing duct being fixedly fitted in the stepped part of the mixing duct holding member.

6. A fuel supply system for a fuel injection device including a fuel injection unit provided with a plurality of fuel injection members, comprising:

a holding-and-supplying unit configured to hold the fuel injection unit and supply fuel to each of the fuel injection members of the fuel injection unit; and a connecting-and-supplying unit configured to connect the plurality of fuel injection members to the holding-and-supplying unit, wherein fuel supply passages are formed in the holding-and-supplying unit and the connecting-and-supplying unit so as to extend from the holding-and-supplying unit to the fuel injection member, and wherein portions of the fuel supply passages formed in the connecting-and-supplying unit are formed so as to overlap each other with respect to a flowing direction of combustion air.

7. A fuel injection device comprising the fuel supply system according to claim 6.

* * * * *